United States Patent [19]

Ten Pas

[11] 4,441,108

[45] Apr. 3, 1984

[54] OMNIDIRECTIONAL MULTIPLE-BAND ANTENNA

[75] Inventor: Jan L. Ten Pas, The Hague, Netherlands

[73] Assignee: U.S. Philips Corporation, New York, N.Y.

[21] Appl. No.: 180,711

[22] Filed: Aug. 25, 1980

Related U.S. Application Data

[63] Continuation of Ser. No. 21,863, Mar. 19, 1979, abandoned.

[30] Foreign Application Priority Data

Mar. 22, 1978 [NL] Netherlands ..... 7803099

[51] Int. Cl.[3] ..... H01Q 5/00; H01Q 21/06

[52] U.S. Cl. ..... 343/857; 343/874; 343/900

[58] Field of Search ..... 343/845, 864, 723, 857, 343/858, 874, 875, 900

[56] References Cited

U.S. PATENT DOCUMENTS

| | | | |
|---|---|---|---|
| 2,124,424 | 7/1938 | Leeds | 343/864 |
| 2,201,857 | 5/1940 | Dome | 343/790 |
| 2,431,124 | 11/1947 | Kees et al. | 343/845 |
| 4,131,895 | 12/1978 | Robinson | 343/874 |

FOREIGN PATENT DOCUMENTS

| | | | |
|---|---|---|---|
| 936029 | 9/1963 | United Kingdom | 343/799 |

OTHER PUBLICATIONS

Thornburg, Multiband J Antenna, Ham Radio, Jul. 1978, 343-900.

*Primary Examiner*—Eli Lieberman
*Attorney, Agent, or Firm*—Robert J. Kraus

[57] ABSTRACT

An omnidirectional multiple-band antenna for use with a plurality of simultaneously operating transceivers wherein a common conductor mast is excited by a plurality of stub-elements arranged therearound and each sized and spaced to excite a half-wave portion of the mast.

8 Claims, 3 Drawing Figures

OMNIDIRECTIONAL MULTIPLE-BAND ANTENNA

This is a continuation of application Ser. No. 021,863, filed Mar. 19, 1979, now abandoned.

BACKGROUND OF THE INVENTION

The invention relates to an omnidirectional multiple-band antenna which can be simultaneously connected to a plurality of transceivers.

In practice, such an antenna has consisted up to the present of a rod antenna to which the transmitters are connected via a resistance network because of the required mutual isolation. There are, however, large losses in such a system and, consequently, bigger transmitters which cause heat transfer problems are required.

In parctice a rod antenna has also been used with a power amplifier connected to it for processing the sum of the signals to be transmitted. This imposes high requirements on the linearity of the amplifier which entails great expense.

Alternatively, two separate antennas have been used in practice, a transmitting antenna and a receiving antenna. Apart from the same problems as for the above-mentioned applications, two antennas must be erected instead of one antenna, which is not attractive from the operational point of view.

SUMMARY OF THE INVENTION

It is an object of the invention to obviate the above-mentioned drawbacks and to provide an omnidirectional multiple-band antenna to which a number of transceivers can be connected and operated simultaneously, either as transmitters or receivers. According to the invention the omnidirectional multiple-band antenna comprises a central mast conductor and a plurality of parallel quarter-wave sub-elements extending near the mast conductor and each being designed for operation at a predetermined, different frequency in the band. The stubs are arranged from bottom to top of the mast conductor around the circumference thereof, so that the portion of the central mast conductor located above each quarter wave stub-element forms, for the associated frequency, an excited half-wave omnidirectional antenna.

BRIEF DESCRIPTION OF THE DRAWING

The invention will now be explained in greater detail with reference to an embodiment shown in the accompanying drawings in which.

DESCRIPTION OF THE PREFERRED EMBODIMENT

Figure 1A:
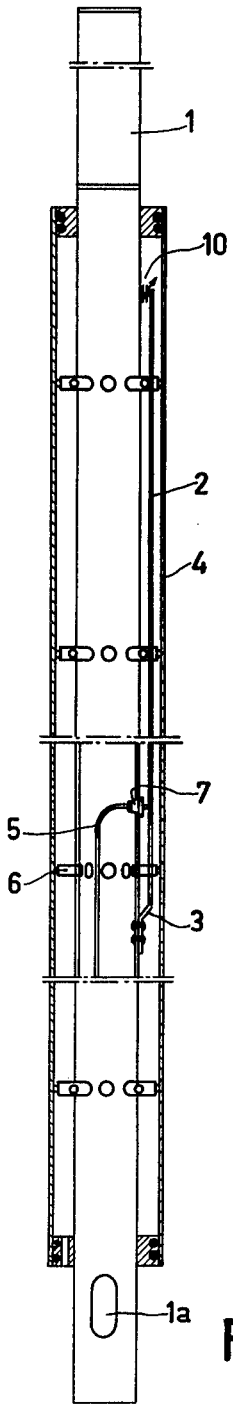
FIG. 1*a* shows a schematical view of the mast conductor having one stub element to which is connected a coaxial antenna cable.
Figure 1B:
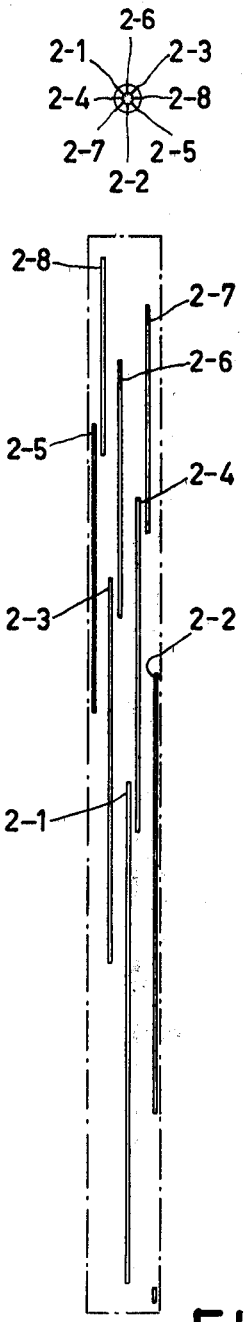
FIG. 1*b* shows schematically an antenna with eight stub-elements distributed about the mast conductor.

The omnidirectional multiple-band antenna shown in FIGS. 1*a* and 1*b* has a vertical central mast conductor 1 and a number of stub-elements 2 disposed parallel to the longitudinal direction and at a small distance, for example 15 mm, from the mast. The bottom 3 of each stub-element is d.c. coupled to the mast conductor. The mast conductor 1 consists of a tube of, for example, aluminium having a diameter of, for example, 6 cm. A single hard-polythylene tube 4 can be placed over the stub-elements and the central mast conductor by means of Delrin coupling members 6 to protect them from the weather. The stub-elements 2 are flat 15 mm wide strips of, for example, aluminium. Each stub-element is a quarter-wave length long at the associated resonant frequency.

The central mast conductor 1 may, for example, be of such a dimension that a wide band, for example, from 30 MHz to 87½ MHz can be covered. The central mast conductor will then have a length of 7½ meters. The central mast conductor and the associated stub-elements may of course also be designed for other frequency bands, and therefore be of a different length.

The length of the stub-element associated with the lowest frequency of 30 MHz then amounts to 2½ meters corresponding to a quarter-wave length. At some distance from the bottom 3, the stub element is connected at point 7 to an antenna cable or transmission line so that the antenna impedance has a real value of approximately 50 Ohm. The antenna cable passes through the interior of the mast conductor and leaves it via an opening 1*a*.

Each quarter-wave stub element 2 forms together with the portion of the central mast conductor opposite thereto a folded half-wave conductor or parallel resonant circuit which electromagnetically excites the $\frac{1}{2}\lambda$ mast conductor portion located thereabove. The folded half-wave conductor, which must be considered to be a parallel resonant circuit, generates a closed electromagnetic field which passes substantially no radiation to the environment. The bottom side of the parallel circuit of the bottom stub-element and, consequently, the bottom side of the mast conductor is electrically cold and the top side of the parallel circuit forms a high-ohmic excited point of the half-wave omnidirectional antenna.

The next stub-element (2) is disposed somewhat higher at the central mast conductor tangentially and axially shifted relative to the preceding stub-element. The mutual interaction between the first and second stub-element of any random pair is low. The currents produced by the parallel resonant circuit associated with the first stub-element in the central mast conductor and in the second stub-element located opposite thereto are in phase, and, consequently, do not affect the electric field associated with the second stub-element.

Figure 2:
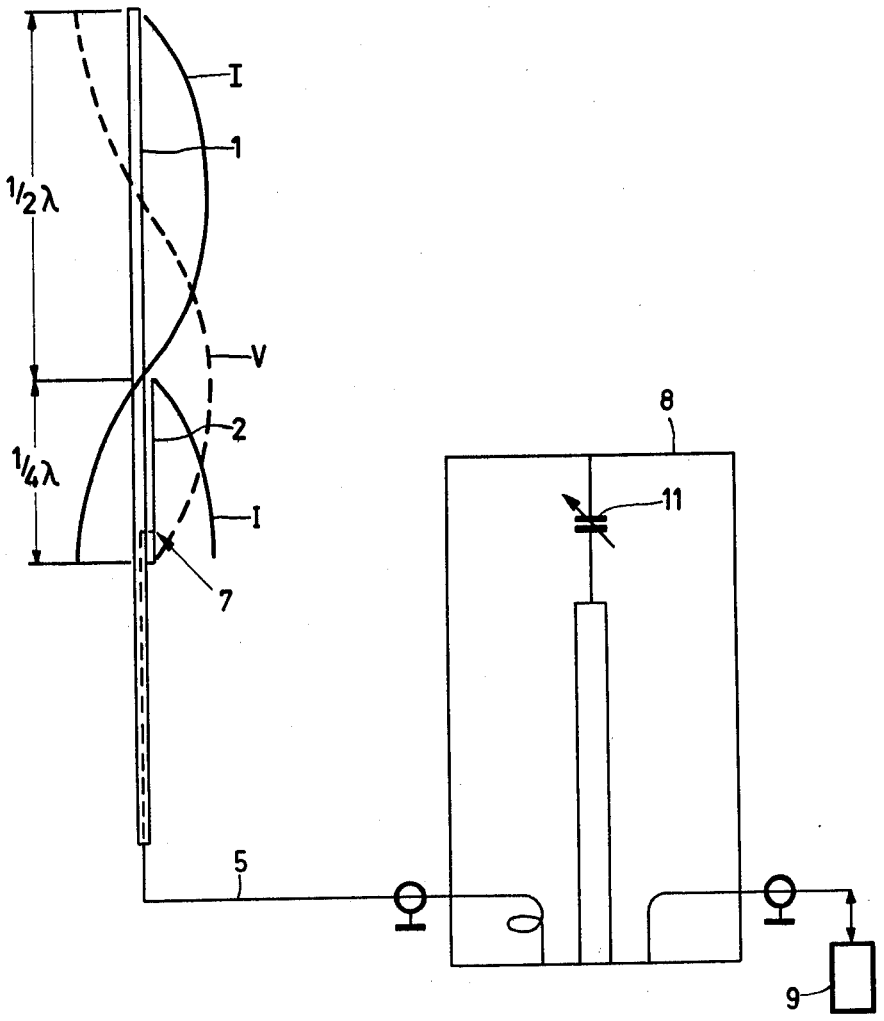
FIG. 2 shows the current and voltage distribution along one stub element and mast conductor, and of the coaxial selective filter.

FIG. 2 shows the current (I) and voltage (V) distribution along one stub-element and the mast conductor.

FIG. 1*b* shows how eight stub-elements 2-1 to 2-8 are distributed along the circumference of the mast conductor (shown in the outwardly folded condition).

The resonant frequencies of the eight stub-elements, are chosen so that each frequency is located in a certain sub-frequency band in the VHF range of 30 to 87.5 MHz. In order to still further reduce the interaction between any two frequency-sequential stub-elements, these two stub-elements are disposed approximately opposite one another on the circumference of the mast conductor. The stub-elements are numbered in sequency of resonant frequency. The anti-clockwise sequence of attachment is 2-1, 2-4, 2-7, 2-2, 2-5, 2-8, 2-3, 2-6, as shown at top in FIG. 1*b*.

For the case of eight stub-elements, eight antenna cables 5 come from the central mast conductor 1. The impedance measured at the output of these cables is approximately real for a band of approximately 0.5

MHz around the relevant resonant frequency. As a consequence, the wide band antenna using the eight stub-elements could only be used for eight bands of a width of approximately 0.5 MHz, each band then being located in the above-mentioned sub-frequency bands respectively.

This drawback can be obviated by providing a variable capacitor 10, one for each stub-element, between the central mast conductor and the upper end of the stub-element. By means of this variable capacitor, which is preferably of the split-stator type, it is possible to tune to any desired frequency in the relevant sub-frequency band. As a result of tuning by means of the variable capacitor and the choice of an advantageous tapping point on the sub-element, an output impedance of approximately 50Ω real is measured at the antenna cable over the entire sub-frequency band.

The length of each stub-element together with the minimum value of the variable capacitor must be in agreement with the highest frequency of the relevant sub-frequency band. When tuning to frequencies in the centre of the sub-frequency bands the attenuation between the antenna cables of frequency-adjacent sub-frequency bands is 32 dB or more.

FIG. 2 shows an additional filter 8, for example a tunable coaxial filter suitable for use for a further selective filter operation.

The bandwidth of the filter is small relative to that of the antenna. The resonant frequency of the filter can be varied over the bandwidth of the stub-element by means of tuning capacitor 11.

After tuning of the stub-elements by means of the variable capacitor 10 it is possible to operate with eight transceivers 9, which can be operated simultaneously at frequencies which are distributed over the entire band.

What is claimed is:

1. An omnidirectional multiple-band antenna for use with a plurality of simultaneously operating transceivers, said multiple-band antenna comprising a central mast conductor, a plurality of elongated stub-elements spaced from said mast and extending in a direction parallel to the longitudinal axis of said mast, said stub-elements being arranged about the perimeter and distributed along the length of said mast conductor, each of said stub-elements being a quarter-wavelength long at a different frequency in an associated frequency band and having one end which is electrically connected to said mast conductor, and means for connecting each stub-element to a transmission line at a point along said stub-element near said one end so that each of said stub-elements forms, with a portion of said mast conductor opposite thereto, a parallel resonant circuit that electromagnetically excites a half-wave portion of the mast above the opposite portion to radiate as a half-wave omnidirectional antenna for the respective frequency band.

2. The multiple-band antenna according to claim 1 wherein said connecting means connects said transmission line to a point along the length of the respective stub-elements such that the antenna formed by the stub-element and the associated portion of said mast conductor has an approximately read input impedance.

3. The multiple-band antenna according to claim 1 or 2 wherein stub-elements operating in adjacent frequency bands are disposed along opposite sides of said axis to reduce interference therebetween.

4. The multiple-band antenna according to claim 3 wherein said mast conductor is approximately three-quarters of a wavelength long at the lowest frequency of the multiple frequency bands.

5. The multiple-band antenna according to claim 3 wherein in operation said mast conductor is in a vertical position and said stub-elements are arranged along said mast conductor in order of decreasing length with the shortest stub-element being the uppermost stub-element.

6. The multiple-band antenna according to claim 1 including a filter arranged in said transmission line between each stub-element and the associated transceiver connected thereto.

7. An omnidirectional multiple-band antenna for use with a plurality of simultaneously operating transceivers, said multiple-band antenna comprising a central mast conductor, a plurality of elongated stub-elements spaced from said mast and extending in a direction parallel to the longitudinal axis of said mast conductor, said stub-elements being arranged about the perimeter and distributed along the length of said mast conductor, each of said stub-elements being a quarter-wavelength long at a different frequency in an associated frequency band so that each of said stub-elements forms, with a portion of said mast conductor opposite thereto, a parallel resonant circuit that electromagnetically excites a half-wave portion of the mast above the opposite portion to radiate as a half-wave omnidirectional antenna for the respective frequency band, and a variable capacitor disposed between said mast conductor and one end of each stub-element.

8. The multiple-band antenna according to claim 7 wherein said capacitor is of a split-stator type.

* * * * *

UNITED STATES PATENT AND TRADEMARK OFFICE

CERTIFICATE OF CORRECTION

PATENT NO. : 4,441,108

DATED : April 3, 1984

INVENTOR(S) : JAN L. TEN PAS

It is certified that error appears in the above—identified patent and that said Letters Patent is hereby corrected as shown below:

CLAIM 2, LINE 6, change "read" to --real--

Signed and Sealed this

*Twenty-fifth* Day of *June 1985*

[SEAL]

*Attest:*

DONALD J. QUIGG

*Attesting Officer* *Acting Commissioner of Patents and Trademarks*